US011203868B2

(12) United States Patent
Maji

(10) Patent No.: US 11,203,868 B2
(45) Date of Patent: Dec. 21, 2021

(54) CEILING ELEMENT

(71) Applicant: SIGNIFY HOLDING B.V., Eindhoven (NL)

(72) Inventor: Goutam Maji, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 16/755,254

(22) PCT Filed: Oct. 11, 2018

(86) PCT No.: PCT/EP2018/077720
§ 371 (c)(1),
(2) Date: Apr. 10, 2020

(87) PCT Pub. No.: WO2019/072961
PCT Pub. Date: Apr. 18, 2019

(65) Prior Publication Data

US 2020/0240142 A1 Jul. 30, 2020

(30) Foreign Application Priority Data

Oct. 13, 2017 (IN) ..... 201741036477
Nov. 27, 2017 (EP) ..... 17203820

(51) Int. Cl.
*F21S 8/04* (2006.01)
*E04B 9/00* (2006.01)
(Continued)

(52) U.S. Cl.
CPC ..... *E04B 9/006* (2013.01); *F21S 8/026* (2013.01); *F21S 9/02* (2013.01); *F21S 8/04* (2013.01);
(Continued)

(58) Field of Classification Search
CPC .. F21S 8/026; F21S 9/20; E04B 9/006; F21V 33/0088
See application file for complete search history.

(56) References Cited

U.S. PATENT DOCUMENTS 3,701,895 A 10/1972 Sweetser
2012/0236575 A1 9/2012 Tsao
(Continued)

FOREIGN PATENT DOCUMENTS

CN 1479403 A 3/2004
CN 102820493 A 12/2012
(Continued)

*Primary Examiner* — Karabi Guharay

(57) ABSTRACT

A ceiling element including a base adapted to be mounted in a ceiling of a room, thereby defining a room space under the base and a ceiling space above the base, is provided. The ceiling element includes a battery container adapted to receive a battery and arranged at the base such that it is located in the ceiling space when the ceiling element is mounted in the ceiling. The ceiling element further includes a conduit arranged to convey air between the room space and the ceiling space and/or the battery space when a temperature of the room space is different from a temperature of the ceiling space and/or a temperature of the battery container. A method of thermal management of a battery received in a battery container located in a ceiling space is also provided.

15 Claims, 2 Drawing Sheets

(51) Int. Cl.

| | |
|---|---|
| ***F21S 8/02*** | (2006.01) |
| ***F21S 9/02*** | (2006.01) |
| *F21V 29/61* | (2015.01) |
| *F21Y 115/10* | (2016.01) |
| *F21V 21/04* | (2006.01) |
| *F21Y 113/00* | (2016.01) |

(52) U.S. Cl.
CPC ..... *F21V 21/041* (2013.01); *F21V 29/61* (2015.01); *F21Y 2113/00* (2013.01); *F21Y 2115/10* (2016.08)

(56) References Cited

U.S. PATENT DOCUMENTS

| | | | |
|---|---|---|---|
| 2014/0052276 | A1 | 2/2014 | Krishnapura et al. |
| 2015/0184839 | A1 | 7/2015 | Amat Girbau et al. |
| 2018/0249563 | A1* | 8/2018 | Alexander ..... F21V 23/045 |

FOREIGN PATENT DOCUMENTS

| | | | |
|---|---|---|---|
| CN | 203386865 | U | 1/2014 |
| CN | 205911396 | U | 1/2017 |
| DE | 3316512 | A1 | 11/1984 |
| EP | 2055849 | A1 | 5/2009 |
| JP | 2006019073 | A | 1/2006 |
| JP | 2008103195 | A | 5/2008 |
| JP | 2010163849 | A | 7/2010 |
| JP | 2010186641 | A | 8/2010 |
| WO | 2009123552 | A1 | 10/2009 |
| WO | 2017158789 | A1 | 9/2017 |

* cited by examiner

CEILING ELEMENT

CROSS-REFERENCE TO PRIOR APPLICATIONS

This application is the U.S. National Phase application under 35 U.S.C. § 371 of International Application No. PCT/EP2018/077720, filed on Oct. 11, 2018, which claims the benefit of European Patent Application No. 17203820.0, filed on Nov. 27, 2017 and Indian Patent Application No. 201741036477, filed on Oct. 13, 2017. These applications are hereby incorporated by reference herein.

TECHNICAL FIELD

The present disclosure relates to the field of thermal management of batteries in ceiling elements. More specifically, the present disclosure relates to thermal management of a battery using room-tempered air.

BACKGROUND

Using batteries to power luminaires may offer a promising solution in terms of for example energy saving and load shedding. When used in combination with false ceilings (or drop ceilings), the batteries may, often for aesthetical reasons, be positioned above the false ceilings such that they are not visible from within the room space below.

The temperature within the space above the false ceiling may be substantially different from the temperature within the room space below. This may make maintaining the battery at an optimal temperature more difficult.

Thus, there is a need for an improved thermal management of batteries when used in combination with false ceilings.

SUMMARY OF THE INVENTION

The present disclosure seeks to at least partially fulfil the above requirements. To achieve this, a ceiling element and a method of thermal management of a battery as defined in the independent claims are provided. Further embodiments are provided in the dependent claims.

According to a first aspect of the present disclosure, a ceiling element is provided. The ceiling element may include a base which may be adapted to be mounted in a ceiling of a room. Thereby, when the ceiling element is mounted in the room, the base may define a room space under the ceiling element and a ceiling space above the ceiling element.

The ceiling element may include a battery container which may be adapted to receive a battery. The battery container may be arranged at the base such that it is located in the ceiling space when the ceiling element is mounted in the ceiling.

The ceiling element may include a conduit which may be arranged to convey air between the room space and the ceiling space and/or the battery container when a temperature of the room space is different from a temperature of the ceiling space and/or a temperature of said battery container. Phrased differently, the conduit may be arranged to convey air between the room space and the ceiling space and/or the battery container when there is a temperature gradient between the room space and the ceiling space and/or the battery container.

For example, if the temperature of the battery container is lower than the temperature of the room space, the temperature of (or within) the battery container may be increased by the conduit conveying warmer air from the room space to the ceiling space (such that the battery container may be heated from the outside) or directly to the battery container. Increasing the temperature of/within the battery container may heat a battery received/located therein. If the temperature of the ceiling space is below a comfort temperature (or comfort temperature interval) of the battery, which may occur for example during winter, the warmer air from the room space may still keep the battery at its comfort temperature (or within its comfort temperature interval). This may for example improve the lifetime and/or capacity of the batter.

As another example, if the temperature of the battery container is higher than the temperature of the room space, the temperature of (or within) the battery container may be decreased by the conduit conveying cooler air from the room space to the ceiling space (such that the battery container may be cooled from the outside) or directly to the battery container. Decreasing the temperature of/within the battery container may cool a battery received/located therein. If the temperature of the ceiling space is above the comfort temperature (or comfort temperature interval) of the battery, which may occur for example during summer, the cooler air of the room space may still keep the battery at its comfort temperature (or within its comfort temperature interval). This may for example also improve the lifetime of the battery.

In other words, the ceiling element as provided in the present disclosure may improve the lifetime and/or capacity of the battery by utilizing the air in the room space to maintain the battery at its comfort temperature (or within its comfort temperature interval).

In some embodiments, the ceiling element may include a luminaire (or light fixture, or light fitting). The luminaire may be connectable to the battery, such that for example a light source of the luminaire may be powered from the battery.

When a temperature of the room space is equal to a temperature of the ceiling space and/or a temperature of said battery container, the conduit may still be arranged to convey air between the room space and the ceiling space and/or the battery container; though the effect of said conveying may e.g. only be advantageous for keeping the process of conveying going, such that no start-up conditions are required when the temperature becomes different.

Herein, a luminaire may be a device which is (or at least includes/hosts) a lighting device such as for example a LED lighting device, a pixilated LED light source, a LED strip, a halogen spot, a light beacon, and/or similar. A luminaire may also be (or at least include/host) for example a display screen, a light panel, or other device from which light may be emitted directly, or indirectly, towards e.g. a room space below the luminaire.

In some embodiments, at least part of the conduit may be arranged in thermal contact with a surface of the luminaire. The surface of the luminaire may for example be a metallic surface, a reflector, a casing, or similar. If the surface of the luminaire is heated by for example a light source of the luminaire, arranging at least part of the conduit in thermal contact with the surface may heat air conveyed through the conduit. If, for example, air is conveyed from the room space to the ceiling space and/or battery container in order to heat a battery, the conveyed air may be heated from the surface of the luminaire, and the heating process may be made more efficient and/or faster.

In some embodiments, the conduit may be arranged to convey the air between the room space and the battery container. By conveying the air directly to/from the battery container, heating (or cooling) of a battery received/located in the battery container may be more efficient and/or faster.

In some embodiments, the ceiling element may include at least one fan. The at least one fan may be adapted to convey the air via the conduit. The at least one fan may for example force air to be conveyed in a certain direction, and/or allow for the air to be conveyed faster. This may improve the process of heating (or cooling) the battery. The fan may be an electric fan, wherein e.g. an electric motor is used to run the fan. The fan may be operable at different speeds, such that the amount of air conveyed by the fan may be controlled as required. The fan may for example be operated manually, and be turned on and off by using e.g. a mechanical switch or by providing a suitable signal on e.g. a control wire. The provided signal may power the fan, or control a relay which open/closes a power supply to the fan according to the signal.

In some embodiments, the ceiling element may include a fan controller. The fan controller may be configured to control the at least one fan. The controlling of the fan may be based on at least one condition. The at least one condition may for example be selected from a first group consisting of whether the battery is charging or discharging (or idle); a time of day and/or calendar date; a weather forecast; a real time cost of electrical energy; a battery state of charge (SOC); a battery age; a battery state of health (SOH); a battery core to surface heat conductivity (i.e. a heat transfer coefficient); a battery size; a battery dimension; a battery form factor, and e.g. a battery surface area.

In some embodiments, the at least one condition may be selected from a second group consisting of a detected temperature of air in the room space; a detected temperature of air in the ceiling space; a detected temperature of air in the battery container, and a detected temperature of the battery.

In some embodiments, the at least one condition may be selected from a group consisting of the elements of both the first group and the second group.

It is envisaged that the at least one condition may include combinations of multiple such elements, selected from the first group, from the second group or from both the first group and the second group.

By controlling the fan (using the fan controller) based on the at least one condition, the controlling of the fan may be more flexible and automated, and more optimal for the lifetime and/or capacity of the battery.

In some embodiments, the ceiling element may include at least one temperature sensor. The at least one temperature sensor may be connected to the fan controller, and configured to detect the detected temperature of air in the room space, the detected temperature of air in the ceiling space, the detected temperature of air in the battery container, and/or the detected temperature of the battery. The connection to the fan controller may be wired (e.g. via at least one cable) or wireless (e.g. via a radio or optical link). The at least one temperature sensor may be separate from the fan controller, or integrated into the fan controller. The at least one temperature sensor may be a single device, or include multiple devices which may be located at different positions. For example, the at least one temperature sensor may include a temperature sensor arranged such that it may measure (detect) the temperature of the room space and one temperature sensor arranged such that it may measure the temperature of the ceiling space and/or one temperature sensor arranged such that it may measure the temperature of the battery container. The temperature sensors may for example measure the temperature of the air of the respective areas, and/or the temperature of surfaces or volumes of the respective areas.

A temperature sensor as defined herein may for example estimate a temperature by measuring thermal expansion of gas and/or solids, change in gas pressure, (infrared) energy emitted by an object, electrical properties, and/or other suitable physical quantities/properties of an object from which the temperature of the object may be derived.

In some embodiments, the fan controller may be configured to control the at least one fan to convey air between the room space and the ceiling space and/or the battery container so as to keep a temperature of the battery within a comfort temperature interval of the battery. Herein, a comfort temperature interval may correspond also to a single temperature, i.e. a comfort temperature of the battery. By using the fan controller and the fan, the temperature management of the battery utilizing the air of the room space, as described earlier herein, may be done automatically without required intervention of a user. The temperature of the battery may for example correspond to the detected temperature of the battery referred to with regards to the at least one condition (as detected e.g. by the at least one temperature sensor). The temperature of the battery may for example correspond to a temperature derived from the detected temperature of air in the battery container and/or in the ceiling space.

It may be noted that the fan controller may also be configured to control the at least one fan so as to keep the temperature of the battery within the comfort temperature interval of the battery without using e.g. a detected temperature of the battery, or e.g. a detected temperature of air in e.g. the battery container and/or the ceiling space. For example, it is envisaged that the fan controller may e.g. rely only on time and/or a forecasted weather and/or other conditions not including one or more detected temperatures (or at least not including a detected temperature of the battery).

As an example, in some embodiments, the fan controller may be configured to heat the battery, on a condition that the temperature of the battery is below (a lower boundary of) the comfort temperature interval of the battery. This may be achieved by the fan controller controlling the fan to convey air from the room space to the ceiling space and/or to the battery container if the detected temperature of air in the room space is higher than the temperature of the battery.

As a further example, in some embodiments, the fan may be configured to cool the battery, on a condition that the temperature of the battery (i.e., the detected battery temperature) is above (an upper boundary of) the comfort temperature interval of the battery. This may be achieved by the fan controller controlling the fan to convey air from the room space to the ceiling space and/or to the battery container if the detected temperature of air in the room space is lower than the temperature of the battery.

As described herein, the temperature of the battery may for example be a detected temperature of the battery (as detected e.g. by the at least one temperature sensor), a temperature derived from e.g. a detected temperature of air in the battery container and/or in the ceiling space, or a temperature derived in other suitable ways. The temperature of the battery may for example be estimated based on time, date, weather forecasts, and or other suitable parameters. The temperature of the battery may be estimated without using one or more detected temperatures.

In some embodiments, the conduit may be arranged to convey air from the room space to the ceiling space and/or to the battery container, and the ceiling element may further include a second conduit. The second conduit may be arranged to convey air from the battery container and/or from the ceiling space to the room space. The conduit and the second conduit may allow for air to be circulated from the room space, via the ceiling space and/or the battery container, and back to the room space.

In some embodiments, both the conduit and the second conduit may be directly connected to the battery container. Connecting both the conduit and the second conduit directly to the battery container may make the processes of maintaining the battery at its comfort temperature (or within its comfort temperature interval) more efficient and/or faster.

In some embodiments, the ceiling element may include a second fan arranged to convey air through the second conduit. In examples, for example, the ceiling element may include two fans, or at least two fans. Each fan may be arranged to convey air through the conduit and the second conduit respectively. Phrased differently, one fan may be arranged to convey air through the conduit, and the other fan may be arranged to convey air through the second conduit. Using two (or more) fans may further improve the process of maintaining the battery at its comfort temperature (or within its comfort temperature interval) by utilizing and circulating air from the room space via the ceiling space and/or the battery container.

In some embodiments, the battery container may be a thermally insulated container. A thermally insulated battery container may for example shield the battery from an ambient air (surrounding the battery container), when the temperature of the ambient air is lower or higher than that of the comfort temperature (or comfort temperature interval) of the battery. A thermally insulated battery container may for example also require less air to be conveyed through the conduit (and the second conduit, if available).

In some embodiments, the ceiling element may further include control electronics. At least a part of the conduit (and/or the second conduit, if available) may be arranged in thermal contact with the control electronics. The control electronics may include e.g. charge controllers, LED drivers or similar, and heat radiated from the control electronics may assist in heating air conveyed through the conduit (and/or the second conduit). This may make the process of e.g. heating a battery to its comfort temperature (or to within its comfort temperature interval) more efficient and/or faster.

In some embodiments, the at least one fan may include a valve which may be operated at least in an open state wherein air is permitted to pass through the valve, and a closed state wherein air is not permitted (or at least restricted) to pass through the valve. In some embodiments, it is envisaged that the valve may be controlled (e.g. operated in the closed state or the opened state) by the fan controller, or by other suitable equipment which may be provided for controlling the valve. The controlling of the valve may for example be based on the temperature of the battery, such that for example the valve is closed to avoid any air flow between the room space and the ceiling space and/or the battery container if the temperature of the battery (or e.g. the detected temperature of air in the ceiling space and/or battery container) is already within the comfort temperature interval of the battery, and opened if it is decided (e.g. by the fan controller) that air should be conveyed between the room space and the ceiling space and/or battery container.

In some embodiments, the at least one fan may be connected to the battery such that the battery may provide power to the at least one fan. This may allow the temperature of the battery to be managed also when no AC-power is available.

According to a second aspect of the present disclosure, a method of thermal management of a battery received in a battery container located in a ceiling space above a base of a ceiling element is provided. The method may include conveying, on a condition that a temperature of the battery is below a comfort temperature interval of the battery, air from a room space below the ceiling element to the ceiling space and/or to the battery container.

The present disclosure relates to all possible combinations of features recited in the claims. Further, any embodiment described with reference to a ceiling element according to the first aspect of the present disclosure may be combined and combinable with any one of the embodiments described with reference to the method according to the second aspect, and vice versa. Likewise, any feature of an element described with reference to the ceiling element according to the first aspect may apply to a corresponding feature of the method according to the second aspect as well, and vice versa.

Further objects and advantages will be described below by means of exemplifying embodiments.

BRIEF DESCRIPTION OF THE DRAWINGS

Exemplifying embodiments will be described below with reference to the accompanying drawings, in which.

Figure 1:
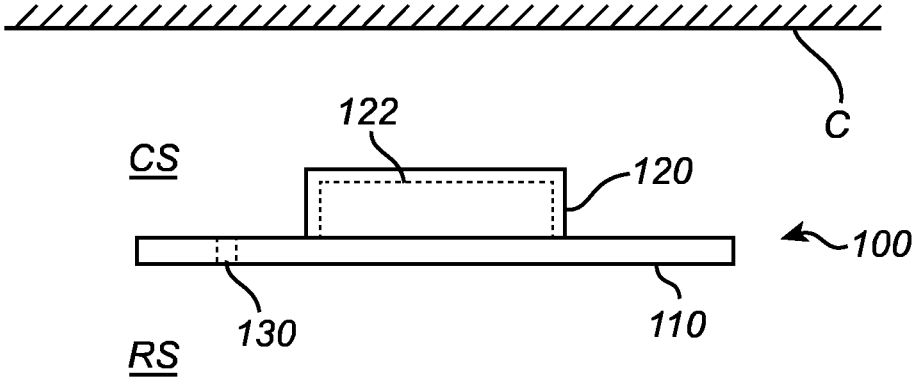
FIG. 1 schematically illustrates a ceiling element according to embodiments of the present disclosure.

In the drawings, like reference numerals will be used for like elements unless stated otherwise. Unless explicitly stated to the contrary, the drawings show only such elements that are necessary to illustrate the example embodiments, while other elements, in the interest of clarity, may be omitted or merely suggested. As illustrated in the figures, the sizes of elements and regions may be exaggerated for illustrative purposes and, thus, are provided to illustrate the general structures of the embodiments.

DETAILED DESCRIPTION

Exemplifying embodiments will now be described more fully hereinafter with reference to the accompanying drawings. The drawings show currently preferred embodiments, but the invention may, however, be embodied in many different forms and should not be construed as limited to the embodiments set forth herein; rather, these embodiments are provided for thoroughness and completeness, and fully convey the scope of the present disclosure to the skilled person.

With reference to FIGS. 1-4, ceiling elements according to some embodiments are described in the following.

FIG. 1 illustrates a ceiling element 100 mounted in a ceiling C. The ceiling element includes a base 110 which defines a room space RS under the ceiling element 100 and a ceiling space CS above the ceiling element 100. The ceiling element 100 may be mounted in the ceiling C using for example wires (not shown) or other suitable methods of suspension, such as for example a ceiling grid (not shown)

which hangs below the ceiling C and which is adapted to receive one or more ceiling elements such as the ceiling element 100. The ceiling element 100 may thereby form part of a false ceiling (or a drop ceiling). Often, such a false ceiling is used to hide for example water pipes, power cables and/or other supply lines which are arranged in the ceiling space CS, such that these supply lines are not visible from within the room space RS. False ceilings may for example be found in office buildings, commercial buildings and/or also in domestic buildings, and similar.

The ceiling element 100 includes a battery container 120 which is adapted to receive a battery 122. The battery container 120 is arranged at the base 110, such that it is located in the ceiling space CS when the ceiling element 100 is mounted in the ceiling C. The battery 122 may be used to power for example luminaires (not shown) or other electrical devices. Using batteries 122 to power such devices, instead of e.g. a direct grid supply, may increase efficiency, lower power consumption, and also serve to provide power to the devices even in the event of a power-grid failure. Such devices may also optionally be present within the battery container 120.

In some situations, the temperature difference between room-tempered air within the room space RS and air in the ceiling space CS may be large. For example, e.g. during winter, the temperature in the ceiling space CS may be lower than room temperature. This may cool the battery 122 (when received/located in the battery container 120) to below its comfort temperature (or below its comfort temperature interval), which in turn may reduce the capacity and lifetime of the battery. If, for example, the battery is a lithium-based battery, its comfort temperature interval may be e.g. between 10-35° C., preferably between 23-25° C. It is also envisaged that the battery container 120 may receive other types of batteries, and that such other types of batteries may also have a corresponding comfort temperature or comfort temperature interval at/in which their lifetime and/or capacity is improved. Here, a comfort temperature (and/or comfort temperature interval) may for example be a temperature at which the battery may sustain an improved number of charging/discharging cycles before a replacement and/or repair of the battery is needed.

In examples, the ceiling space CS may also in summer be colder than the room space RS, as the applicant has found in many examples that counterintuitively the CS is colder in buildings than the RS, whereas one would generally expect heat goes up and will accumulate in the CS.

In other situations, the temperature in the ceiling space CS may be well above the comfort temperature (or comfort temperature interval) of the battery 122. For example due to the presence of heating piping or installed electronics. This may also reduce e.g. the life-time of the battery.

To counteract the temperature difference, the ceiling element 100 includes a conduit 130 which is arranged to convey air between the room space RS and the ceiling space CS and/or the battery container 120 when a temperature of the room space RS is different from a temperature of the ceiling space CS and/or a temperature of the battery container 120. By utilizing the room-tempered air in the room space RS, the conduit may thereby help to maintain the temperature of the battery 122 at its comfort temperature (or within its comfort temperature interval).

In the ceiling element 100, the conduit 130 extends between an opening in the base 110 facing the room space RS and an opening in the base 110 facing the ceiling space CS. The conduit 130 is arranged to convey air between the room space RS and the ceiling space CS. By changing the temperature of the air in the ceiling space CS, the temperature of the battery container 120 is indirectly changed by being (at least on its outside) in thermal contact with the air in the ceiling space CS.

Figure 2:
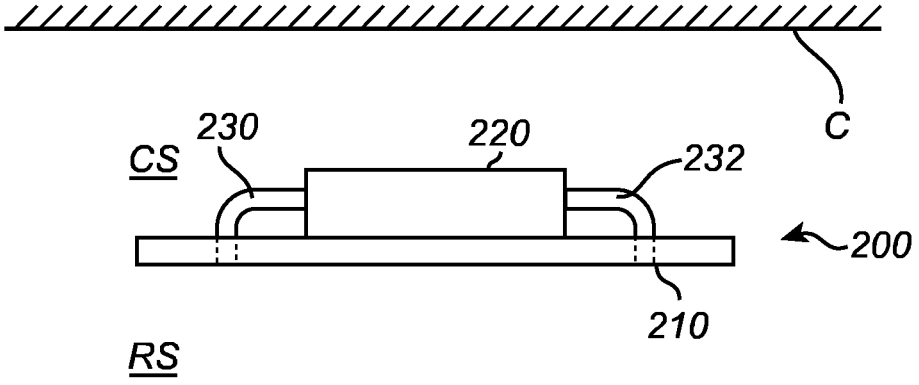
FIG. 2 schematically illustrates a ceiling element according to embodiments of the present disclosure.

FIG. 2 illustrates a ceiling element 200 which includes a base 210 and a battery container 220 adapted to receive a battery (not shown). The battery container 220 is arranged within the ceiling space CS. The ceiling element 200 includes a conduit 230 and a second conduit 232. Each of the conduit 230 and the second conduit 232 extends between an opening in a surface of the base 210 facing the room space RS and an opening in a surface of the battery container 220. The conduits 230 and 232 are arranged to convey air between the room space RS and the battery container 220. In contrast to the ceiling element 100 described with reference to FIG. 1, the temperature inside the battery container 220 may be changed directly (instead of indirectly via the ceiling space CS), as the air is conveyed directly between the room space RS and the battery container 220. By using two conduits, air from the room space RS may be circulated via the battery container 220.

Although the ceiling element 200 is illustrated as having two conduits 230 and 232, it is envisaged that the ceiling element 200 may include only one conduit (such as the conduit 230). It is also envisaged that the ceiling element 200 may include more than two conduits, where each conduit may be arranged to convey air between the room space RS and the battery container 220 and/or the ceiling space CS.

Figure 3:
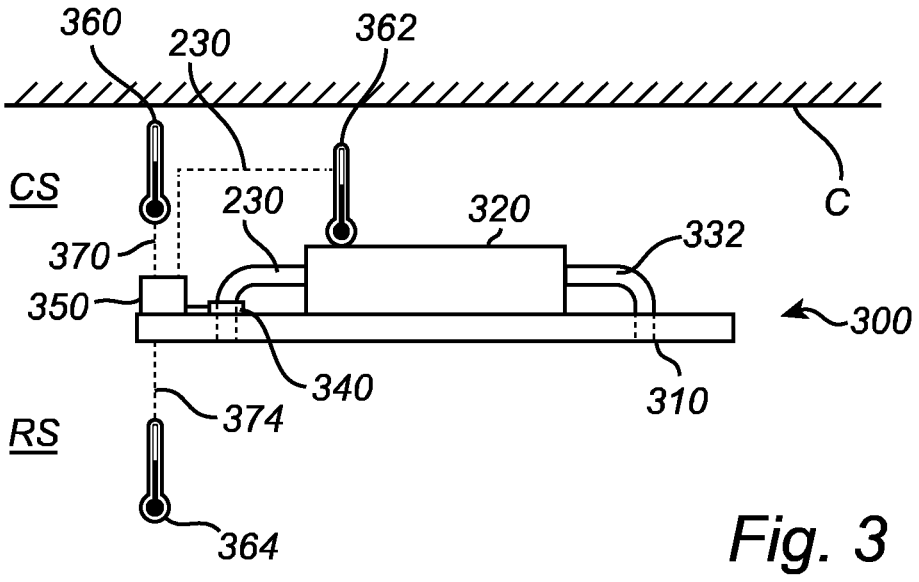
FIG. 3 schematically illustrates a ceiling element according to embodiments of the present disclosure.

FIG. 3 illustrates a ceiling element 300 which includes a base 310, a battery container 320 which is adapted to receive a battery (not shown), and two conduits 330 and 332 arranged to convey air between the room space RS and the battery container 320 (which is located in the ceiling space CS).

The ceiling element 300 further includes a fan 340 arranged to convey air through the conduit 330. The ceiling element 300 includes also a fan controller 350 which is configured to control the fan 340. The fan controller 350 may control the fan 340 based on at least one condition. Examples of such conditions will be given further below. The ceiling element 300 includes several temperature sensors 360, 362 and 364 which are configured to detect the temperature of the ceiling space CS, the temperature of the battery container 320 (and/or of a battery received in the battery container 320), and the temperature of the room space RS, respectively. The temperature sensors 360, 362 and 364 are connected to the fan controller via links 370, 372 and 374, respectively, illustrated by the dashed lines. The links 370, 372 and 374 may for example be cables (i.e. wired connections) or radio- and/or optical links (i.e. wireless connections), or a combination thereof.

It is envisaged that fewer or more temperature sensors may be included in the ceiling element 300. The number, and position, of temperature sensor may for example depend on which condition(s), and/or on which detected temperature(s) (if any), the fan controller 350 controls the fan 340 based upon. For example, if the fan controller 350 controls the fan 340 based on a detected temperature of air the room space RS only, the temperature sensors 360 and 362 may be optional, etc. If, for example, the fan controller 350 controls the fan 340 based on no particular detected temperature, or on one or more temperatures for which values are provided to the fan controller 350 in other ways, all of the temperature sensors 360, 362 and 364 are optional. It is assumed that the respective links 370, 372 and 374 are included only if their corresponding temperature sensor is included.

Although not shown, it is also envisaged that other sensors may be included in the ceiling element 300 and connected to the fan controller 350. Such sensors may for example include voltage and/or current sensors, light sensors, humidity sensors, and similar, and it is also envisaged that the fan controller 350 may be connected e.g. to the Internet in order to receive data based on which the fan 340 may be controlled. Such data may for example include weather data, time and/or date data, scheduling data, and similar.

Examples of how the fan controller 350 may control the fan 340 will now be given. It is envisaged that a fan controller and a fan (and e.g. temperature sensors, other sensors and links, as/if required) may also be included in other embodiments of a ceiling element, such as the ceiling element 100 presented with reference to FIG. 1 or the ceiling element 200 presented with reference to FIG. 2). The examples given below apply to these, and other, embodiments as well.

To control the fan 340, the fan controller 350 may use for example the temperature ($T_{CS}$) of the ceiling space CS (detected and provided to the fan controller e.g. by the temperature sensor 360). If, for example, $T_{CS}$ falls below a certain threshold value, the fan controller 350 may decide to operate the fan 340 in an on-state wherein the fan is running in a direction suitable to force air from the room space RS to the battery container 320. This may allow the room-tempered air of the room space RS to heat the battery within the battery container 320 to its comfort temperature or to within its comfort temperature interval (herein, it is assumed that the comfort temperature of the battery may also include only a single comfort temperature of the battery). When the temperature of the battery is as desired, as e.g. determined by the fan controller 350, the fan controller 350 may operate the fan 340 in an off-state wherein the fan 340 is not running. If $T_c$ once again drops below the certain threshold value, the fan controller 350 may operate the fan 340 in the on-state again.

The certain threshold value may be provided to the fan controller 350 using e.g. a link, or determined by the fan controller 350 itself. The certain threshold value may be updated dynamically, and depend on e.g. a status of the battery, a time and/or date, or on other data provided to the fan controller 350. The certain threshold value may for example correspond to the comfort temperature (or to the lower boundary of the comfort temperature interval) of the battery.

It is also envisaged that the fan controller 350 may use other methods to control the fan 340 in a similar way. For example, the speed at (and/or direction in) which the fan 340 is running when in the on-state may be controlled by the fan controller 350 based on e.g. an actual difference between $T_{CS}$ and the certain threshold value, or similar. It is also envisaged that the fan controller 350 may use various other control algorithms, including e.g. differentiation and/or integration of one or more such difference signals or similar (corresponding to e.g. a P-, PI-, PD- or PID-controller).

Instead of, or in addition to, using $T_{CS}$, the fan controller 350 may use the temperature ($T_{BC}$) of the battery container (and/or of the battery), as detected and provided to the fan controller 350 e.g. by temperature sensor 362. The operation of the fan 340 based on $T_{BC}$ may be similar to as already described above with reference to $T_{CS}$.

The fan controller 350 may also, or instead, use the temperature ($T_{RS}$) of the room space in order to control the fan 340. $T_{RS}$ may be detected and provided to the fan controller 350 e.g. by the temperature sensor 364.

If, for example, it is decided (e.g. by the fan controller 350) that $T_{CS}$ and/or $T_{BC}$ are too low (e.g. below a comfort temperature or comfort temperature interval of the battery), and if it is decided that $T_{RS}$ is higher than $T_{CS}$ and/or $T_{BC}$, the fan controller 350 may operate the fan 340 in an on-state wherein air is conveyed from the room space RS to the battery container 320 in order to heat the battery received therein. The speed of the fan 340 in the on-state may also be a function of for example a difference between e.g. $T_{CS}$ (and/or $T_{BC}$) and $T_{RS}$, as described above.

In the above examples, the fan controller 350 may also, or instead, use the temperature ($T_B$) of the battery (for example instead of, or in addition to, $T_{BC}$). $T_B$ may for example be detected by a temperature sensor, or derived from other detected temperatures (such as e.g. $T_{BC}$ and/or $T_{CS}$) and/or calculated using other parameters.

In addition to, or instead of, one or more temperatures, the at least one condition, based on which the fan controller 350 may control the fan 340, may include other conditions. Such a condition may for example be whether the battery is charging or discharging, and/or whether the battery is idle (i.e. not charging or discharging). If the battery, for example, is heated due to power losses during charging and/or discharging, less heat may be needed to be transferred to the battery from the air in the room space RS. Likewise, if the battery is idle, it may be decided that more air from the room space RS is needed to be conveyed to the battery, and the fan controller 350 may operate the fan 340 accordingly.

One condition may be if a time and/or calendar date is at a certain value or within a certain interval. For example, it may be decided that the fan 340 should be operated in an on-state if the time is such that the temperature in the ceiling space CS is normally cooler (e.g. during night-time). The fan controller 350 may then operate the fan 340 to convey room-tempered air from the room space RS to the battery in the battery container 320 in order to heat the battery. As another example, it may be decided that the fan 340 should be operated in an on-state if the calendar date is such that the temperature in the ceiling space CS is normally cooler (e.g. during winter). The fan controller 350 may then operate the fan 340 accordingly in order to provide heat to the battery in the battery container 320.

One condition may be based on a forecasted weather. If it is, for example, decided that the weather will be cold outside, the fan controller 350 may operate the fan 340 accordingly to heat the battery within the battery container 320, and similar. Forecasted weather data may for example be provided to the fan controller 350 via a network, such as the Internet.

One condition may be based on a real-time cost of electricity. If the real-time cost of electricity is determined to be high, the fan controller 350 may select not to operate the fan 340 in an on-state, or at least to not operate the fan 340 in a high-speed on-state, in order to reduce power consumption and cost. Real-time cost of electricity data may be provided to the fan controller 350 using e.g. a network, such as the Internet.

Other conditions may for example include various states of the battery itself, such as its state of charge (SOC), age, state of health (SOH), core-to-surface heat conductivity (i.e. heat transfer coefficient), size, dimension, form factor and/or surface area. For example, if a battery is decided to be more sensitive to lower operating temperatures at a certain age, the fan controller 350 may account for this and operate the fan 340 accordingly.

It may be noted that, according to the present disclosure, the fan controller 350 may control the fan 340 based on several temperatures or conditions, and/or on combinations thereof. For example, the fan controller 350 may take both a time/date and a temperature into account, and operate the fan 340 based thereon. Multiple other such combinations are possible, and although separate examples are not given herein for each such combination, it is envisaged that a fan controller according to the present disclosure may use all suitable such combinations of conditions and/or temperatures to control the at least one fan.

Figure 4A:
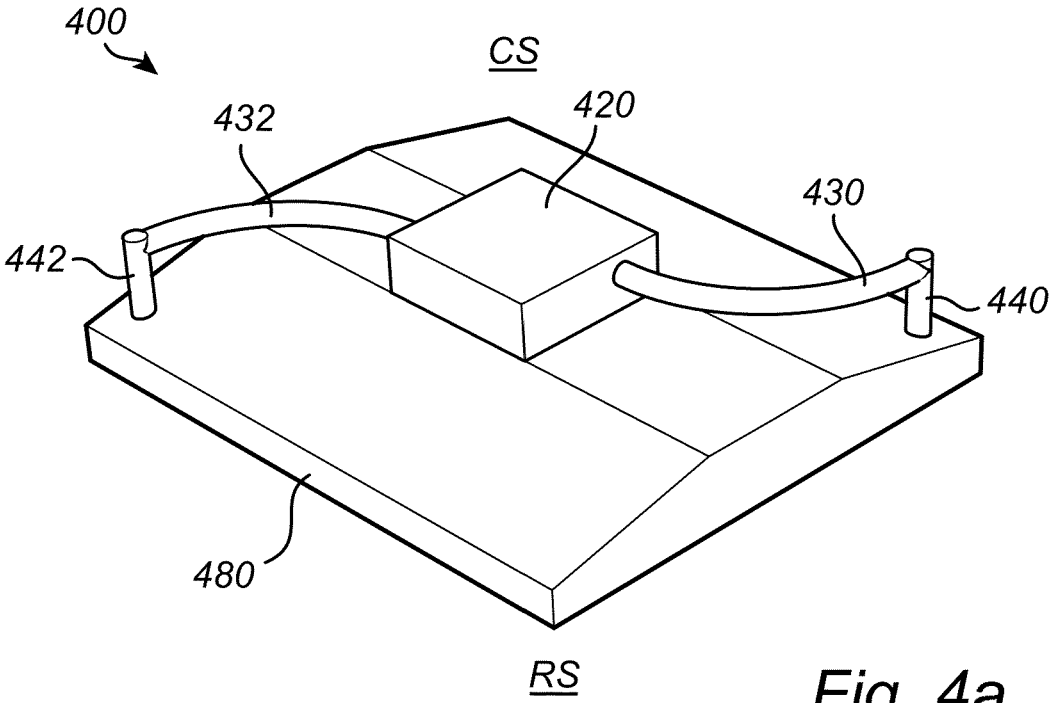
FIGS. 4*a* and 4*b* illustrate a ceiling element according to embodiments of the present disclosure.
Figure 4B:
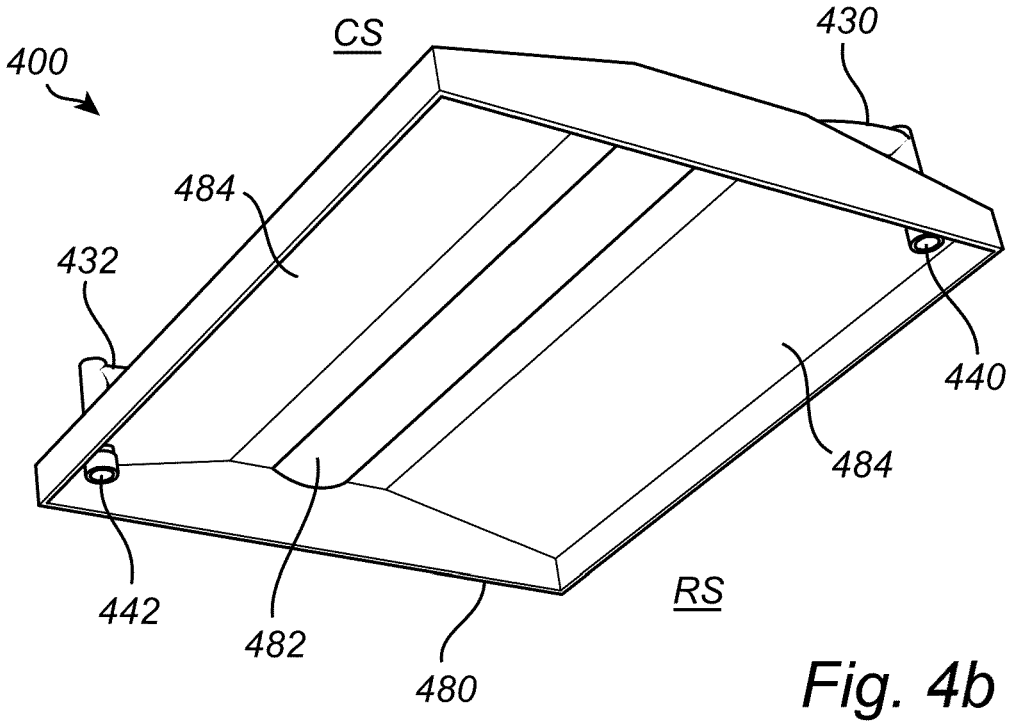

FIGS. 4*a* and 4*b* illustrate, from different perspective directions, a ceiling element 400 which includes a battery container 420 which is adapted to receive a battery (not shown). The ceiling element 400 includes a luminaire 480 which forms the base of the ceiling element 400, and defines a ceiling space CS and a room space RS when the ceiling element 400 is mounted in a ceiling (not shown). The battery container 420 is arranged in the ceiling space CS (when the ceiling element 400 is mounted in the ceiling)

The luminaire 480 includes a light source 482 and a reflector surface 484 arranged to direct light emitted by the light source 482 towards the room space RS. If the battery is present in the battery container 420, the luminaire 480 (and the light source 482) may be connected to the battery such that the battery may provide power to the light source 482.

The ceiling element 400 includes a conduit 430 and a second conduit 432, each of which extends between the surface 484 and the battery container 420. When the light source 482 is turned on, the (reflector) surface 484 may be heated. It may be envisaged that air close to the surface 484 will then also be heated. The conduit 430 and the second conduit 432 are arranged such that at least part of them (e.g. their openings at the surface 484) are in thermal contact with the surface 484. Air conveyed through the conduit 430 and the second conduit 432 will thereby also be heated when passing through the part of the conduits which are in thermal contact with the surface 484 of the luminaire 480.

The openings of the conduit 430 and the second conduit 432 at the surface 484 are located at a distance from each other such that air output through one opening will not immediately get sucked back into the opening of the other opening (provided that air is circulated from the room space RS through one conduit, via the battery container 420 and back to the room space RS through the other conduit). In the ceiling element 400, the openings are arranged in opposite corners of the surface 484.

For similar purposes, the openings of the conduits 430 and 432 at the surface of the battery container 420 are also located at opposite corners of the battery container 420. This may allow for a more substantial flow of air over/around the battery in the battery container 420.

The ceiling element 400 also includes two fans 440 and 442. The fan 440 is arranged to convey air through the conduit 430, and the fan 442 is arranged to convey air through the conduit 432. The fans 440 and 442 are located close to the openings of the conduits 430 and 432 at the surface 484. It is also envisaged that the fans 440 and 442 may be located at other positions, as long as they may assist to convey air through the conduits 430 and 432, respectively.

The ceiling element 400 may also include a fan controller (not shown), temperature sensors, other sensors, links and similar in order to control the fans 440 and 442 such that room-tempered air may be circulated via the conduits 430 and 432 and the battery container 420, in order to utilize the room-tempered air to heat the battery in the battery container 420 if decided necessary.

The fan controller may for example control the fans 440 and 442 such that air is sucked in from the room space RS through one of the conduits 430 and 432, conveyed via the battery container 420, and then thrown out back into the room space RS through the other one of the conduits 430 and 432. For example, the fan controller may control the fan 440 to suck air in from the room space RS, and control the fan 442 to throw air back out into the room space RS. In this case, the opening of the conduit 430 at the surface 484 is an inlet, and the opening of the conduit 432 at the surface 484 is an outlet. Needless to say, it may be envisaged that the fans 440 and 442 are controlled in the opposite directions, such that the opening of the conduit 430 at the surface 484 is an outlet and the opening of the conduit 432 at the surface 484 is an inlet.

It may also be envisaged that a ceiling element, such as any one of the ceiling elements 100, 200, 300 and 400 as described herein with reference to FIGS. 1, 2, 3 and 4, respectively, includes only a single conduit and fan, and that the fan is operated such that air is conveyed from the room space RS to the battery container (and/or the ceiling space) during one time interval, and that the fan is operated such that air is conveyed back from the battery container (and/or the ceiling space) to the room space RS during another, non-overlapping time interval. This may allow for a battery received in the battery container to be heated from the room-tempered air of the room space with only a single conduit and fan.

Likewise, it may be envisaged that a ceiling element including more than one conduit and more than one fan which operate according to the same principle, such that air is conveyed from the room space RS to the battery container (and/or the ceiling space) through the conduits during one time interval, and such that air is conveyed back from the battery container (and/or the ceiling space) during another, non-overlapping time interval.

To further improve the thermal management of the battery (i.e. to keep the battery at, or close to, its comfort temperature or within its comfort temperature interval), a battery container as defined herein may be thermally insulated. The battery container may for example have an insulating layer (e.g. an insulating foam, plastic, rubber, or similar) on its containing surfaces. The battery container may be closed such that air may only enter the battery container through one or more conduits.

Although not illustrated herein, it is envisaged that a ceiling element may also contain various control electronics, such as charge controllers or drivers for light sources (such as e.g. an LED driver). The one or more conduits may be arranged such that at least part of them are in thermal contact with such control electronics. If the control electronics generate heat when operated, the generated heat may then be transferred at least in part to the one or more conduits, and assist in heating air being conveyed through the at least one or more conduits.

Although features and elements are described above in particular combinations, each feature or element may be used alone without the other features and elements or in various combinations with or without other features and elements.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite article "a" or "an" does not exclude a plurality. The mere fact that certain features are recited in mutually different dependent claims does not indicate that a combination of these features cannot be used to advantage.

The invention claimed is:

1. A ceiling element including a base and adapted to be mounted in a ceiling of a room, in mounted position thereby defining a room space under the base and a ceiling space above the base, said ceiling element comprising:

a battery container adapted to receive a battery and arranged at the base such that it is located in the ceiling space when said ceiling element is mounted in the ceiling, and a conduit arranged to convey air between the room space and the ceiling space or between the room space and the battery container when a temperature of said room space is different from a temperature of said ceiling space and/or a temperature of said battery container, wherein on a condition that a temperature of the battery is below a comfort temperature interval of the battery, air from the room space below the base of the ceiling element is conveyed to the ceiling space or from the room space below the base of the ceiling element to the battery container.

2. The ceiling element of claim 1, wherein the ceiling element comprises a luminaire connectable to the battery.

3. The ceiling element of claim 2, wherein at least a part of the conduit is arranged in thermal contact with a surface of the luminaire.

4. The ceiling element of claim 1, wherein the conduit is arranged to convey the air between the room space and the battery container.

5. The ceiling element of claim 1, further comprising at least one fan adapted to convey the air via the conduit.

6. The ceiling element of claim 5, comprising a fan controller configured to control the at least one fan based on at least one condition selected from the group consisting of: a detected temperature of air in the room space; a detected temperature of air in the ceiling space; a detected temperature of air in the battery container; a detected temperature of the battery; whether the battery is charging or discharging; a time of day and/or calendar date; a weather forecast; a real time cost of electrical energy; a battery state of charge; a battery age; a battery state of health; a battery core to surface heat conductivity; a battery size; a battery dimension; a battery form factor, and a battery surface area.

7. The ceiling element of claim 6, comprising at least one temperature sensor connected to the fan controller and configured to detect the detected temperature of air in the ceiling space, the detected temperature of air in the battery container, and/or the detected temperature of the battery.

8. The ceiling element of claim 6, wherein the fan controller is configured to control the at least one fan to convey air between the room space and the ceiling space and/or the battery container so as to keep the temperature of the battery within the comfort temperature interval of said battery.

9. The ceiling element of claim 8, wherein the fan controller is configured to heat the battery, on the condition that the temperature of the battery is below said comfort temperature interval, by controlling the fan to convey air from the room space to the ceiling space and/or to the battery container if the detected temperature of air in the room space is higher than the temperature of the battery.

10. The ceiling element of claim 8, wherein the fan controller is configured to cool the battery, on a condition that the temperature of the battery is above said comfort temperature and/or comfort temperature interval, by controlling the at least one fan to convey air from the room space to the ceiling space and/or to the battery container if the detected temperature of air in the room space is lower than the temperature of the battery.

11. The ceiling element of claim 1, further comprising control electronics, wherein at least a part of the conduit is arranged in thermal contact with said control electronics.

12. A ceiling element including a base and adapted to be mounted in a ceiling of a room, in mounted position thereby defining a room space under the base and a ceiling space above the base, said ceiling element comprising:

a battery container adapted to receive a battery and arranged at the base such that it is located in the ceiling space when said ceiling element is mounted in the ceiling, and a conduit arranged to convey air between the room space and the ceiling space or between the room space and the battery container when a temperature of said room space is different from a temperature of said ceiling space and/or a temperature of said battery container, wherein the ceiling element further comprises a second conduit arranged to convey air from the battery container and/or from the ceiling space to the room space, and wherein on a condition that a temperature of the battery is below a comfort temperature interval of the battery, air from the room space below the base of the ceiling element is conveyed to the ceiling space or from the room space below the base of the ceiling element to the battery container.

13. The ceiling element of claim 12, wherein both the conduit and the second conduit are directly connected to the battery container.

14. The ceiling element of claim 12, wherein a second fan is arranged to convey air through the second conduit.

15. A method of thermal management of a battery received in a battery container located in a ceiling space above a base of a ceiling element, comprising:

conveying, on a condition that a temperature of the battery is below a comfort temperature interval of the battery, air from a room space below the base of the ceiling element to the ceiling space or from the room space below the base of the ceiling element to the battery container.

* * * * *